US005101741A

United States Patent [19]

Gross et al.

[11] Patent Number: 5,101,741

[45] Date of Patent: Apr. 7, 1992

[54] FLOW LINE BAKE-OUT PROCESS FOR INCINERATOR

[75] Inventors: Paul J. Gross, Montville; Raymond Elsman, South Plainfield, both of N.J.

[73] Assignee: JWP Air Technologies, Mountainside, N.J.

[21] Appl. No.: 698,536

[22] Filed: May 10, 1991

[51] Int. Cl.[5] ..... F23B 7/00

[52] U.S. Cl. ..... 110/233; 110/235; 110/236; 110/346; 165/5; 165/95; 422/175; 431/5; 431/215; 432/181; 432/182

[58] Field of Search ..... 432/179, 180, 181, 182; 165/95, 5; 134/19; 110/235, 233, 341, 346, 236; 431/5, 215; 422/175, 173

[56] References Cited

U.S. PATENT DOCUMENTS

| | | | |
|---|---|---|---|
| 3,888,302 | 6/1975 | Rounds | 165/5 X |
| 4,257,475 | 3/1981 | Jakob | 165/5 X |
| 4,499,943 | 2/1985 | Schafer | 165/95 |
| 4,829,703 | 5/1989 | Watson et al. | 432/181 |
| 4,944,670 | 7/1990 | Watson | 432/181 X |
| 4,961,908 | 10/1990 | Pehnington et al. | 422/175 X |

*Primary Examiner*—Edward G. Favors
*Attorney, Agent, or Firm*—Dykema Gossett

[57] ABSTRACT

A method of cleaning flow structure within a regenerative fume incinerator of the type having a plurality of heat exchange chambers for directing fluid into and out of a combustion chamber. Each of the heat exchange chambers have a separate inlet and outlet line which are cyclically opened such that air to be cleaned is continuously being directed into the combustion chamber through one of the chambers, and cleaned air is continuously directed out of the combustion chamber through an alternative one of the chambers. The flow structure, valves and manifolds may become clogged with residue from the air being combusted. An alternate inlet line communicates from the source of fluid directly into the combustion chamber. That line is opened when cleaning of the flow structure is desired. At the same time flow to the normal inlet manifold is closed. The inlet and outlet valves continue to be cyclically opened and closed during cleaning such that the heated air from the combustion chamber is exposed to both those inlet and outlet lines, valves and manifolds. In a preferred embodiment, a normally closed line connects the inlet and outlet manifold, and is opened during cleaning such that one relatively large outlet manifold is effectively formed by the entire flow structure, which would include the inlet and outlet manifolds, the inlet and outlet lines and their associated valves.

14 Claims, 2 Drawing Sheets

FLOW LINE BAKE-OUT PROCESS FOR INCINERATOR

BACKGROUND OF THE INVENTION

This application in general relates to a structure and method for cleaning valves and manifolds in an incinerator.

Regenerative fume incinerators are known in which a combustion chamber communicates with a plurality of heat exchange chambers. Each of the plurality of heat exchange chambers alternately communicates cool "dirty" air to be cleaned into a combustion chamber, and then receives hot cleaned air from the combustion chamber. The heat exchange chambers may have separate inlet and outlet lines each containing valves. The plurality of inlet lines leading into each of the heat exchange chambers may communicate with a common inlet manifold, while the plurality of outlet lines may communicate with a common outlet manifold. The inlet and outlet valves are cyclically opened and closed such that air is directed through one chamber into the combustion chamber while air is directed outwardly of another chamber. Heat exchange structure in the chambers takes heat from the hot discharge air. Once that chamber cyclically becomes an inlet chamber, the entering cool air is heated as a preheat prior to combustion. The basic operation of such incinerators is disclosed in U.S. Pat. No. 4,470,806, the disclosure of which is incorporated herein by reference.

Such incinerators are used to remove contaminants from cool "dirty" air to be incinerated. Thus, the air passing through the flow lines toward and away from the heat exchange chambers may contain contaminants. This may lead to dried, condensed solids or other residue building up on the flow lines and valves. This is particularly true for the inlet valves and inlet flow lines. To a lesser extent the outlet lines and valves are also exposed to contaminants. It would be desirable to disclose a system which can quickly and efficiently clean the flow lines and valves.

SUMMARY OF THE INVENTION

A method and apparatus for cleaning flow structure leading to and from a fluid chamber is disclosed. In particular, the flow structure preferably includes inlet and outlet manifolds, inlet and outlet lines and valves on those lines.

In a preferred embodiment of the present invention, the fluid chamber is a combustion chamber for a regenerative type incinerator. In such incinerators, air to be cleaned is directed into an inlet manifold and through one of a plurality of heat exchange chambers into the combustion chamber. Each of the heat exchange chambers has a separate inlet and outlet line leading back to the respective manifolds. Each of the inlet and outlet lines have valves which are cyclically opened and closed to direct flow into and out of the combustion chamber. As is known, at least three heat exchange chambers are preferably used. One inlet line is typically opened while at least one outlet line on another heat exchange chamber is typically opened. In this way, cool air to be cleaned is continuously directed in through one heat exchange chamber, and is combusted within the combustion chamber. The hot cleaned air is continuously directed outwardly of at least one of the other heat exchange chambers. The hot air heats the heat exchange chamber and is cooled. The heat exchange chambers are cyclically shifted between inlet and outlet flow of air such that heat exchange structure within each of the chambers is cyclically heated and cooled. In this way, the heat exchange structure provides a preheat to the air to be cleaned entering the combustion chamber.

With such incinerators, residues can build up on the flow structure leading into and out of the heat exchange chambers. Such residues would include contaminants typically found in the air to be cleaned. These contaminants can build up residue on the inlet and outlet manifolds, the inlet and outlet lines and valves found on those lines. In the present invention, an alternate inlet line communicates with the inlet manifold upstream of the communication of the inlets to the heat exchange chambers. A valve is placed in the inlet manifold downstream of the communication of the alternate inlet line, but upstream of the communication of the inlets to the heat exchange chambers. The alternate inlet line may communicate directly into the combustion chamber, although flow through the alternate inlet line is normally closed by a valve. A connection valve is mounted on a line which communicates the inlet and outlet manifolds, and is also normally closed.

When it is desired to clean the flow structure, the valve on the alternate inlet line is opened. At the same time, the connection valve between the inlet and outlet manifolds is opened. The valve in the inlet manifold between the connection of the alternate inlet line and the inlets to the various heat exchange structures is closed. The normal inlet and outlet valves continue to be cyclically opened and closed, and heated air from the combustion chamber is thus directed through both the inlet and outlet valves. The heated air thus communicates with both the inlet and outlet lines and valves, and also with the manifolds. Since the manifolds communicate, a relatively large outlet manifold is effectively formed by the combined flow structure of the inlet and outlet manifolds, the inlet and outlet lines, and their valves. The air passes outwardly of all the heat exchange chambers, and thus the air is not cooled. The heated air bakes off residue built-up on the flow structure.

In a most preferred embodiment of the present invention, a fan is mounted on the outlet manifold and normally draws fluid out of the heat exchange chambers through the opened outlet lines. The normal flow from this fan is reduced during cleaning operation such that only a relatively small volume of air passes through the combustion chamber during cleaning. The temperature within the combustion chamber is also reduced from normal temperatures ensuring that it is not overly high for the flow structure. The temperature is maintained adequate to bake off the built-up residue.

These and other objects and features of the present invention can be best understood from the following specification and drawings of which the following is a brief description.

BRIEF DESCRIPTION OF THE DRAWINGS

The FIG. 1 is a largely schematic view of a incinerator embodying a valving system for performing a method of cleaning.

DETAILED DESCRIPTION OF A PREFERRED EMBODIMENT

Figure 1:
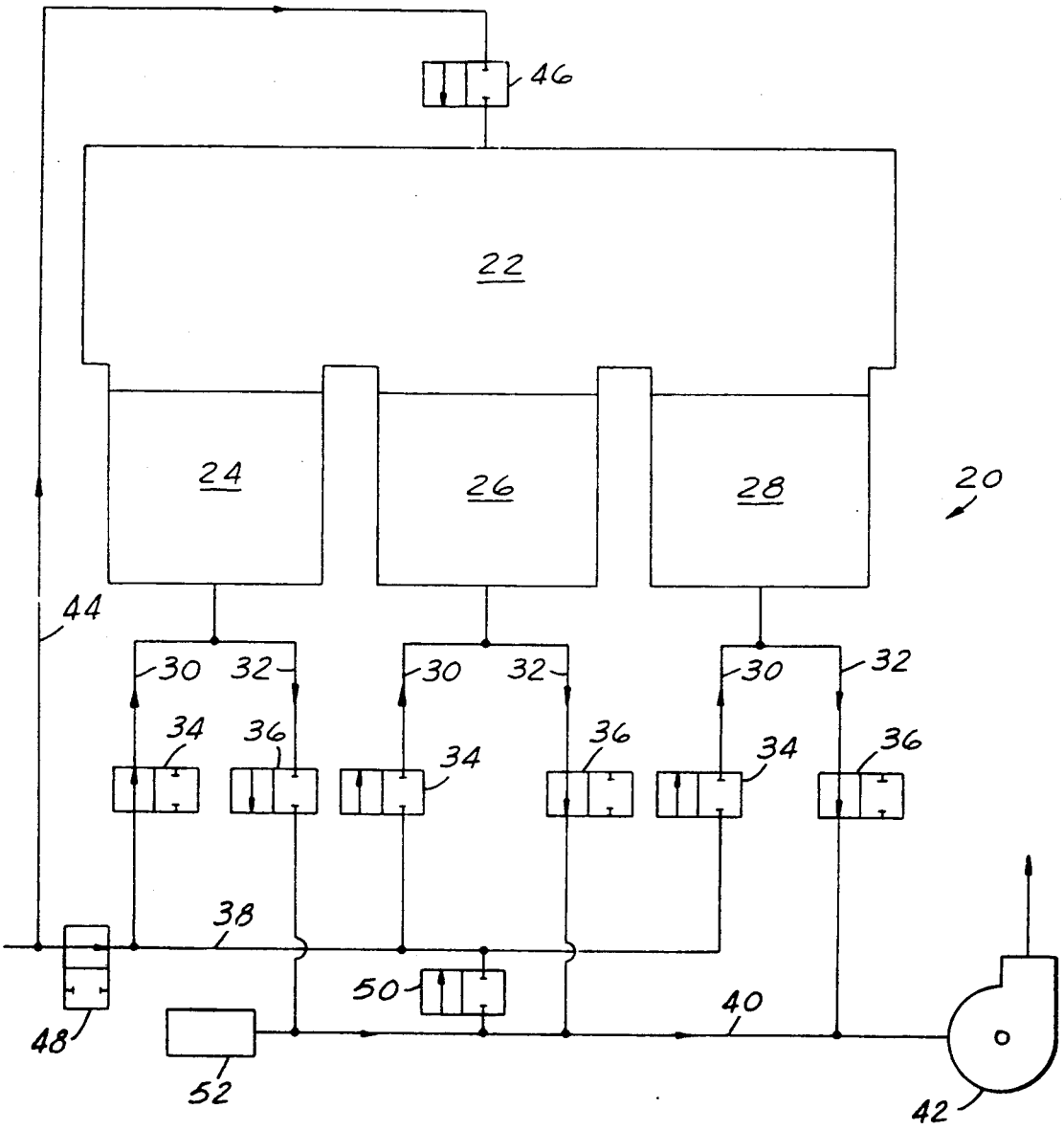

FIG. 1 illustrates incinerator 20 including a plurality of heat exchange chambers 24, 26 and 28 leading into combustion chamber 22, when contains known combustion structure. Each chamber 24, 26 and 28 has a separate inlet 30 and outlet 32. Inlet 30 and outlet 32 merge into a common line immediately before chambers 24, 26 and 28. Inlet 30 includes inlet valve 34, while outlet 32 includes outlet valve 36. The plurality of inlet lines 30 from the chambers communicate with a common inlet manifold 38, while the plurality of outlet lines 32 all communicate with a common outlet manifold 40. Fan 42 is disposed downstream of chambers 24, 26 and 28 on outlet manifold 40 and pulls air from combustion chamber 22 through outlet lines 32, and draws air from inlet lines 30.

As is known, contaminant laden air to be cleaned is directed into inlet manifold 38, and then into combustion chamber 22 through one of chambers 24, 26 or 28. That air passes through heat exchange structure found in each of chamber 24, 26 and 28. The air moving into combustion chamber 22 through the heat exchange chamber is heated by the heat exchange structure such that it is preheated prior to incineration. At the time air is passing in through the inlet line 30 associated with one heat exchange chamber, shown here as chamber 24, air is being directed outwardly of at least one of chambers 26 and 28. Some structure is used to cyclically time the opening and closing of the valves. The valves are typically opened and closed by a cam arrangement, although electronic, hydraulic, pneumatic, or other controls could be used.

The air passing into combustion chamber 22 typically contains contaminants. These contaminants can cause residue build-up on the flow structure, and in particular, inlet lines 30, inlet valves 34, and inlet manifold 38. Residue may also build-up on outlet lines 32, valves 36 and manifold 40.

The method of the present invention bakes these residue off the flow structure. To accomplish this bake-out an alternate inlet line 44 communicates with inlet manifold 38 at a position upstream of the connection of inlets 30 to manifold 38. Alternate inlet line 44 is closed during normal operation of incinerator 20 by valve 46. An inlet manifold isolation valve 48 is disposed intermediate the connections of alternate inlet line 44 and the inlets 30 in manifold 38. Valve 48 is open during normal operation. A manifold communication valve 50 is disposed on a line connecting inlet manifold 38 to outlet manifold 40. This valve is closed during normal operation. A clean air damper 52 connected to outlet manifold 40 is closed during normal operation.

Figure 2:
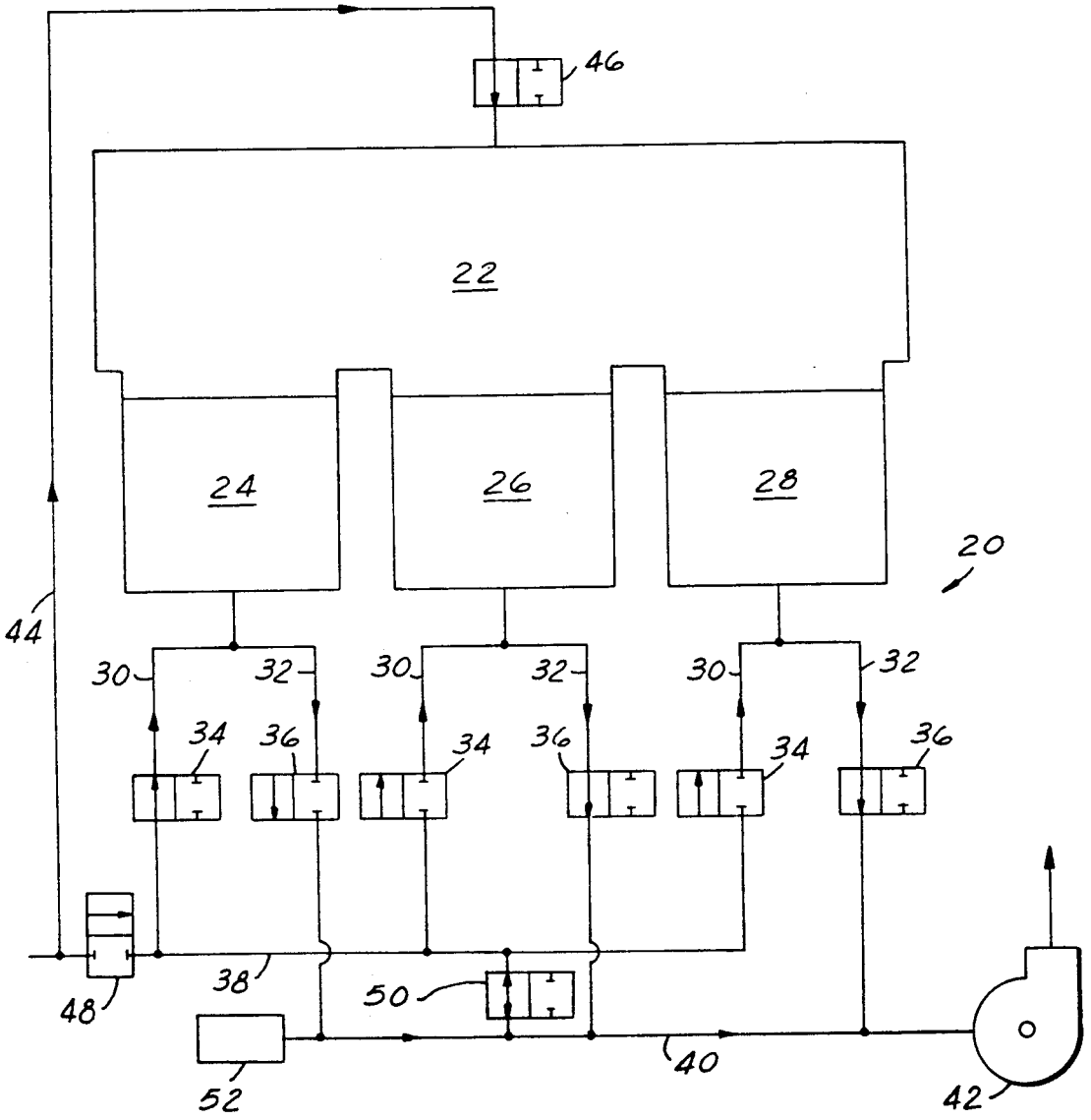
FIG. 2 shows the system of FIG. 1 in a cleaning position.

A method of cleaning the various structure leading into and out of chambers 24, 26 and 28 is illustrated in FIG. 2. The temperature within combustion chamber 22 is decreased from its normal operating levels. Further, the flow volume from fan 42 is reduced. Valves 46 and 50 are opened and valve 48 is closed. Air is directed into combustion chamber 22 through alternate inlet line 44. Inlet manifold 38 is closed from the source of inlet air since valve 48 is closed. Outlet manifold 40 communicates directly with inlet manifold 38 since valve 50 is opened. The valves 36 and 34 leading to chamber 24, 26 and 28 continue to be cyclically opened and closed. As air from alternate inlet line 44 passes into combustion chamber 22 it is heated to very high temperatures. That high temperature fluid passes outwardly of chambers 24, 26, and 28, through both inlet lines 30 and outlet lines 32, and passes through valves 34 and 36 as they are cyclically opened. The heated fluid passes into inlet manifold 38 and outlet manifold 40. Thus, the flow lines and valves of the fluid flow system are exposed to this high temperature fluid which bakes-off or oxidizes dried, or condensed solids.

It could be said that a single relatively large outlet manifold is formed from the combined flow structure of both inlet manifold 38, outlet manifold 40, inlet lines 30, outlet lines 32, and valves 34 and 36. The relatively high temperature fluid leaving the combustion chamber during the cleaning operation communicates with all of this flow structure, effectively baking off built up residue on such structure.

During normal operation, the high temperature fluid leaving the combustion chamber is cooled by the heat exchange structure in chambers 24, 26 and 28. Thus, the air reaching the outlet flow structure is not typically of an extremely high temperature. When the valves are moved to the cleaning position shown in FIG. 2, the chambers 24, 26 and 28 are not cyclically cooled by the cool inlet air. Thus, the chambers 24, 26 and 28 soon reach a temperature that is approximately equal to the outlet temperature of the air leaving combustion chamber 22. In this way, the air leaving chambers 24, 26 and 28 through the outlet lines 32 is much hotter than is typically exposed to the outlet flow structure. Thus, this air also serves to remove residue from the outlet flow structure.

It is desirable that the temperature of the air leaving the combustion chamber during cleaning is selected such that it is not overly high for the flow structure and valves. To this end, the clean air damper 52 is mounted on an end of outlet manifold 40 and will bleed cool clean air into outlet manifold 40 during cleaning. This ensures that the air which reaches fan 42 is not overly high, and will not exceed the temperature of the air which may be moved by fan 42.

In a preferred embodiment of the present invention the main exhaust fan may reduce the flow from the incinerator 20 to one-fourth of its normal full flow values which would include the bleed in air from damper 52. In one embodiment, the bleed in air accounts for 30% of that ¼ flow level. The cleaning combustion chamber temperature is preferably 900° to 1100° Fahrenheit. A typical operating temperature during normal combustion is 1500° to 2000° Fahrenheit.

The valves as used in this invention, are preferably of the "cast step-seated valve" type which will allow minimal leakage. An acceptable valve is available from Valv-Tech of Fogelsville, Pa., under their model number BRS 2234L.

A preferred embodiment of the present invention has been disclosed, however, a worker of ordinary skill in the art would recognize that certain modifications would come within the scope of this invention. For that reason the following claims should be studied in order to determine the true scope and content of this invention.

Claims:

1. A method of cleaning flow structure leading into a chamber, wherein a normal inlet line communicates with a source of fluid to direct fluid into the chamber, and an outlet line allows fluid to flow outwardly of the chamber, wherein valves are disposed on the normal inlet line and the outlet line and open and close to control flow into and out of the chamber, the fluid being directed into the chamber, heated within the chamber and directed out of the chamber, such that heated fluid normally passes through the outlet line, the method comprising the steps of:

(1) providing an alternate inlet line, and closing off communication between the source of fluid and the normal inlet line; and (2) opening the alternate inlet line such that fluid passes into the chamber and is heated within the chamber, while opening the inlet valve on the normal inlet line while the heated fluid is passing outwardly of the chamber, the heated fluid thus passing into the normal inlet line and through the inlet valve such that the normal inlet line and inlet valve is exposed to the heated fluid, which removes residue.

2. The method as recited in claim 1, wherein the chamber is a combustion chamber, there are a plurality of the normal inlet and outlet lines and valves, and wherein the plurality of inlets and outlets all communicate with a single combustion chamber where the fluid is incinerated, there being a single alternate inlet line extending into the combustion chamber.

3. The method as recited in claim 2, wherein each of the separate normal inlet and outlet lines communicate with one of a plurality of heat exchangers, the heat exchangers all communicating with the combustion chamber, and wherein the valves on the normal inlet and outlet lines are cyclically opened and closed, the cyclic opening and closing of the inlet and outlet valves continuing while the alternate inlet line is open such that the heated fluid passes cyclically through the inlet and outlet valves.

4. A method as recited in claim 3, wherein a single inlet manifold communicates the source of fluid to each of the normal inlet lines to the heat exchangers, a single outlet manifold communicates with each of the outlets lines and a fluid line having a connection valve connects the inlet and outlet manifolds, the connection valve being opened when the alternate inlet line is opened such that the inlet and outlet manifolds become a single outlet manifold, and the heated fluid contacts all flow structure within both the inlet and outlet manifolds to remove residue.

5. A method as recited in claim 1, wherein the chamber is a combustion chamber which incinerates contaminants from the fluid prior to directing it to the outlet.

6. The method as recited in claim 5, wherein there are a plurality of heat exchangers leading into a single combustion chamber, with each of the heat exchangers having a separate normal inlet and outlet line, and fluid is alternately directed through one heat exchanger into the combustion chamber and out of a different heat exchanger such that the heat exchangers are normally cyclically exposed to cool fluid passing into the combustion chamber and hot clean fluid passing outwardly of the combustion chamber.

7. The method as recited in claim 6, wherein a fan draws fluid from the plurality of outlets.

8. The method as recited in claim 7, wherein the fluid is air.

9. The method as recited in claim 7, wherein cool air is communicated to the outlet line upstream of the fan.

10. A method of cleaning flow structure leading into a chamber, wherein the chamber has at least one inlet and at least one outlet comprising the steps of:

(1) closing off either the inlet or the outlet line at a position removed from the chamber; and (2) directing a cleaning fluid at least into the closed line such that the heated fluid communicates with the closed line to remove residue.

11. The method as recited in claim 10, wherein the cleaning fluid is heated.

12. The method as recited in claim 11, wherein a line normally connects the inlet line to a source of fluid and an inlet valve controls flow into the chamber, the inlet line being closed upstream of the inlet valve such that the heated fluid contacts the inlet valve and the inlet line to remove residue on the valve.

13. The method as recited in claim 11, wherein an alternate inlet line leads into the chamber, the alternate inlet line is opened and the inlet line is closed during step (1), and heated fluid is directed into both the inlet and outlet lines to remove residue during step (2).

14. An incinerator comprising:

a combustion chamber;

a plurality of heat exchange chambers leading into said combustion chamber, each of said plurality of heat exchange chambers having a separate valved inlet and outlet line, an inlet manifold connecting said inlet lines of said heat exchange chambers, an outlet manifold connecting said outlet lines of said heat exchange chambers;

an alternate inlet line communicating said inlet manifold directly into said combustion chamber, an alternate inlet valve normally closing said alternate inlet line;

an isolation valve on said inlet manifold downstream of the communication point of said alternate inlet line but upstream of said inlet lines;

a communication line communicating said inlet and outlet manifolds and a connection valve normally closing said communication line; and said valves being operable such that said isolation valve may be closed, said alternate inlet line valve may be opened, and said connection valve may be opened such that air may be directed through said alternate inlet line into said combustion chamber, heated within said combustion chamber, and directed outwardly of said plural heat exchange chambers, said air passing into a single flow chamber defined by said inlet and outlet lines, valves, and manifolds to remove residue.

* * * * *